US008776546B2

(12) United States Patent
Davidian et al.

(10) Patent No.: US 8,776,546 B2
(45) Date of Patent: Jul. 15, 2014

(54) AIR SEPARATION PROCESS AND APPARATUS USING CRYOGENIC DISTILLATION

(75) Inventors: Benoit Davidian, Saint Maur des Fosses (FR); Pierre Bodelin, Vanves (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 1068 days.

(21) Appl. No.: 12/305,490

(22) PCT Filed: Jun. 19, 2007

(86) PCT No.: PCT/EP2007/056085

§ 371 (c)(1),
(2), (4) Date: May 15, 2009

(87) PCT Pub. No.: WO2008/003585

PCT Pub. Date: Jan. 10, 2008

(65) Prior Publication Data

US 2009/0314031 A1 Dec. 24, 2009

(30) Foreign Application Priority Data

Jul. 4, 2006 (FR) ..... 06 52793

(51) Int. Cl.
*F25J 3/00* (2006.01)
*F17C 9/02* (2006.01)

(52) U.S. Cl.
USPC ..... 62/656; 62/640; 62/643; 62/644; 62/50.2

(58) Field of Classification Search
USPC ..... 62/640, 643, 644, 656
See application file for complete search history.

(56) References Cited

U.S. PATENT DOCUMENTS

| | | | | | |
|---|---|---|---|---|---|
| 4,698,079 | A | * | 10/1987 | Yoshino | 62/656 |
| 5,157,927 | A | * | 10/1992 | Darchis et al. | 62/656 |
| 5,224,336 | A | * | 7/1993 | Agrawal et al. | 62/656 |
| 5,355,680 | A | | 10/1994 | Darredeau | |
| 5,996,373 | A | | 12/1999 | Greter | |
| 6,155,078 | A | * | 12/2000 | Miyashita et al. | 62/643 |
| 6,273,936 | B1 | * | 8/2001 | Barry et al. | 95/12 |
| 6,357,259 | B1 | * | 3/2002 | Higginbotham et al. | 62/656 |

FOREIGN PATENT DOCUMENTS

| | | | |
|---|---|---|---|
| EP | 0 538 857 | | 4/1993 |
| EP | 0538857 | A1 * | 4/1993 |

OTHER PUBLICATIONS

PCT Search Report for PCT/EP2007/056085.

* cited by examiner

*Primary Examiner* — Frantz Jules
*Assistant Examiner* — Keith Raymond
(74) *Attorney, Agent, or Firm* — Justin K. Murray; Elwood L. Haynes; Allen E. White

(57) ABSTRACT

An air distillation unit comprises an air distillation column (10) suitable for producing a nominal flow of gaseous nitrogen, the top of said column being connected to a liquid nitrogen source (8), and operates by carrying out the following steps: a flow of compressed, cooled and purified air is sent to an exchanger (11) and then to the column, a flow of gaseous nitrogen is withdrawn from the column, the level of liquid at the bottom of the column is controlled; and injection liquid (20), sent from the source to the column, is no longer sent if the required production reduces to at most the nominal production. Application to the separation of air by cryogenic distillation.

15 Claims, 5 Drawing Sheets

AIR SEPARATION PROCESS AND APPARATUS USING CRYOGENIC DISTILLATION

This application is a §371 of International PCT Application PCT/EP2007/056085, filed Jun. 19, 2007.

BACKGROUND

1.Field of the Invention

The present invention relates to an air separation process and apparatus using cryogenic distillation. In particular, it relates to the production of nitrogen using a single column kept refrigerated by liquid injection (the sending of liquid nitrogen coming from an external source into the top of the column). The aim of the invention is more particularly to meet moderate and variable demands (typically 100 to 2000 $Sm^3/h$) of high-purity nitrogen, that is to say nitrogen containing typically less than 0.1% oxygen. In the present specification, the flow rates in question are mass flow rates.

High-purity nitrogen is usually obtained cryogenically. For low consumptions, the construction of a conventional autonomous production unit represents a prohibitive level of investment in the case of automated installations, and a more limited level of investment but high labour costs in the opposite case. This always amounts to a high cost price of the nitrogen.

A more economical solution consists in using an evaporator, that is to say a liquid nitrogen tank of large capacity, for example several tens of thousands of liters, from which liquid nitrogen is withdrawn and vaporized. This solution is not very satisfactory from the energy standpoint, since the refrigeration energy contained in the liquid nitrogen is lost and, furthermore, it requires the presence relatively nearby of a liquid nitrogen production unit in order for the cost of replenishing the evaporator by a tanker lorry to remain moderate.

2. Related Art

Sometimes a gaseous nitrogen generator with liquid injection is installed with an emergency delivery system consisting of an evaporator, which makes it possible either to deliver gas to the customer if the apparatus is defective or to produce more gaseous nitrogen if the customer consumes more than the nominal production of the apparatus. The liquid from the emergency delivery system is generally vaporized in an atmospheric heater as may be seen in EP-A-0452177.

When there is a peak in consumption by the customer, liquid nitrogen from the storage tank is vaporized in an atmospheric exchanger (or a water pool) in order to top-up with nitrogen molecules, which nitrogen will be mixed with the nitrogen product output by the cryogenic apparatus. The refrigeration power of the liquid is therefore lost.

Liquid nitrogen also serves to keep the apparatus cold, by liquid injection. The amount of liquid nitrogen sent to the apparatus under steady operating conditions is about 3% of the nitrogen flow produced by the apparatus.

SUMMARY OF THE INVENTION

The invention proposes to recover some of the refrigeration power of the liquid that has been vaporized when the emergency delivery system is used for a peak in consumption.

According to the invention, when there is a peak in consumption, all or some of the liquid, which according to the prior art had to be vaporized in an atmospheric heater in order to top up with molecules, is sent to the distillation column via the liquid injection line.

In the distillation column, this inflow of liquid increases the level of reflux into the column. For a constant air throughput, it is then possible to extract more nitrogen than the nominal amount from the apparatus, by increasing the level of extraction. This increase in output makes it possible to have virtually one additional gas molecule per liquid molecule added. The column therefore acts as a "vaporizer" for liquid coming from the storage tank.

The consequence of increasing the reflux of the column is an excess production of column bottoms liquid rich relative to the nominal production. This excess results in the recovery of the refrigeration of the liquid coming from the storage tank. This excess will be stored either in the bottom of the column or in a dedicated container.

This mode of operation of the apparatus stops when the peak in demand is over or when the LR (rich liquid) storage capacity is reached. The level of extraction returns to its nominal value and the apparatus produces its nominal capacity (FIG. 2). If the peak in demand continues (FIG. 3), the top-up with molecules is again provided by the atmospheric vaporization.

The stored rich liquid will be used to keep the apparatus cold, instead of conventional liquid nitrogen injection. Depending on the customer consumption profile, it is even conceivable for there to be enough autonomy between two peaks in consumption to completely dispense with liquid injection.

There is therefore a not insignificant reduction in operating costs, by reducing or even eliminating the consumption of liquid nitrogen.

According to a first aspect of the invention, a process according to Claim 1 is provided.

The liquid injection flow is considered as being essentially stopped if it does not exceed 10%, or even 5%, of the liquid injection flow sent during the first operation. The most advantageous situation is obviously when the flow is stopped.

According to other optional aspects:

- the unit includes an emergency delivery system and, during the second and/or third operation of the column, liquid nitrogen is sent from the source to the emergency delivery system, where it vaporizes;
- the increase x in molar flow rate of the injection flow during the second operation is between 0.8 and 1.2 times the increase in terms of molar flow rate of the flow produced by the column;
- during the second operation, the injection flow is increased relative to the flow B during the first operation and liquid nitrogen is vaporized in the emergency delivery system;
- during the second operation, the injection flow is increased relative to the flow during the first step and liquid nitrogen is not vaporized in the emergency delivery system, and during the third operation, if the required production remains above the nominal production, injection liquid is stopped being sent into the column, at least initially, and liquid nitrogen is vaporized in the emergency delivery system;
- the level of bottoms liquid, either in the bottom of the column or in a tank connected to it, is controlled;
- during a third operation of the column, liquid injection flow B+x to the column is stopped if the required production is reduced to at least a nominal production or, if the required production is not reduced to at least the nominal production, if the level of bottoms liquid exceeds a first threshold;
- during a third operation of the column when the level of bottoms liquid reaches a first threshold, injection liquid continues to be sent with a flow B so that the level of bottoms liquid remains constant, and the injection flow is stopped when the required production is at least reduced to the nominal production;

during a fourth operation of the column, injection liquid is again sent to the column if the level of bottoms liquid falls below a second threshold;

during the fourth operation, if the required production is equal to or less than the nominal production, a flow B of injection liquid is again sent to the column and no liquid flow is sent to the emergency delivery system; and during the fourth step, if the required production is above the nominal production, a flow B+x of injection liquid is sent to the column and liquid is optionally sent to the emergency delivery system if the liquid injection (and the over-production of the column that ensues therefrom) is insufficient.

According to another aspect of the invention, a cryogenic distillation air separation apparatus is provided which comprises:

i) an exchanger;

ii) a distillation column;

iii) a line for feeding compressed, purified and cooled air to the exchanger and from the exchanger to the column;

iv) a line for feeding gaseous nitrogen from the column to the exchanger in order to warm it as product;

v) an overhead condenser for condensing nitrogen at the top of the column;

vi) a liquid nitrogen feed line coming from an external source, the liquid nitrogen feed line being connected to the top of the column; and vii) means for detecting the bottoms level of the column, said means being connected to a liquid nitrogen feed line, characterized in that the means for detecting the bottoms level of the column are capable of stopping the flow of liquid nitrogen being sent to the column if the bottoms level reaches a high threshold and/or of restarting the flow of liquid nitrogen sent to the column if the bottoms level reaches a low threshold.

BRIEF DESCRIPTION OF THE FIGURES

One example of the implementation of the invention will now be described in conjunction with the appended drawings, in which.

DETAILED DESCRIPTION OF THE INVENTION

Figure 1:
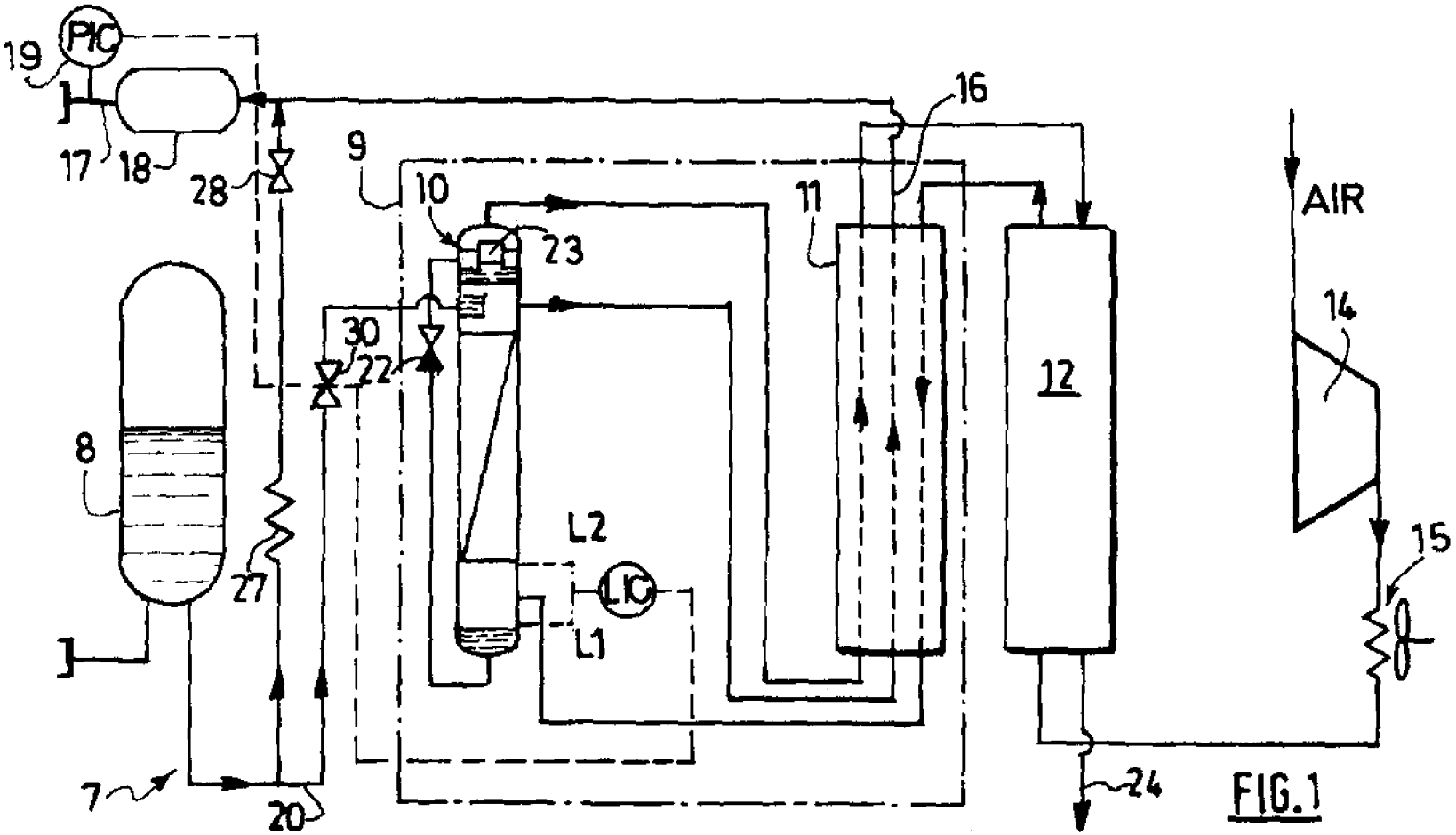
FIG. 1 shows schematically a unit according to the invention.

The unit 7 shown in FIG. 1 essentially comprises:

the aforementioned tank 8;

a cold box 9 containing, on the one hand, an air distillation column 10 and, on the other hand, a heat exchanger 11;

an air purification apparatus 12 operating by adsorption;

an air compressor 14; and an air chiller 15.

The tank 8 may also be inside the cold box or even form a structure integrated into the column 10.

The line 16 runs into a use line 17 equipped with a buffer tank 18 and, downstream of the latter, with a pressure sensor 19.

The operation of the unit 7 will now be described with regard to FIGS. 1, 2, 3, 4A, 4B and 5. FIG. 1 shows an air separation apparatus according to the invention. In the diagrams of FIGS. 2, 3, 4A, 4B and 5, the time t is plotted on the X-axis and several parameters are plotted on the Y-axis, the meaning of which parameters will be explained later.

The nominal operation DN for which the column is designed will firstly be addressed.

In this operation (corresponding to $t<t_1$ in FIG. 2), the nitrogen consumption C (FIG. 2*a*) is constant and equal to the nominal flow DN, and the sensor 19 indicates a constant pressure P. A low average flow B of liquid nitrogen, for example equal to about 3% of DN (FIG. 2*b*), is introduced, via a line 20 equipped with a regulating solenoid valve 30, into the top of the column 10 and serves to keep it cold and also to increase the amount of reflux of the column. The incoming air, compressed by the compressor 14, pre-cooled by the air chiller 15, purified in the apparatus 12 and cooled down to close to its dew point in the exchanger 11, is introduced into the bottom of the column 10. The rich liquid that has collected in the bottom of the column is expanded in an expansion valve 22, vaporized in the overhead condenser 23 of the column, warmed by flowing counter-currently with the air in the exchanger and then used to regenerate the apparatus 12, before being discharged via a line 24 as waste gas. The condenser 23 may be integrated into the exchanger 11 or be attached to the column, as shown in the figure.

At time $t_1$ it will be assumed that the gaseous nitrogen consumption (or demand) starts to increase, reaching a fixed value D' above the nominal flow (FIG. 2*a*).

The flow D of injected liquid nitrogen is equal to 15% of the nominal flow, in order to increase the production of the column, i.e. a value of B+x. Some of the liquid serving for the peak in consumption will be injected via the liquid injection line, to be "vaporized" in the distillation column. The refrigeration power is therefore recovered in the form of rich liquid in the bottom of the column, where it is stored. This store can then be used to keep the apparatus cold, instead of injecting liquid nitrogen.

The benefit of the invention is that it saves on liquid nitrogen, hence a reduction in operating costs.

If the level of rich bottoms liquid of the column 10 reaches a high value L2 (FIG. 2*c*), by closing the valve 30 liquid nitrogen is stopped being sent to the top of the column from the line 20. If the gaseous nitrogen demand reduces to the nominal flow or below this value, the liquid nitrogen injection will be stopped.

Over a given period $t_2$-$t_3$, the apparatus may continue to produce the nominal flow, without liquid injection, by using the stored rich bottoms liquid to provide the refrigeration. Obviously, this lowers the level of rich liquid, and when a level L1 is reached it is necessary to restart sending liquid nitrogen into the column.

When the gaseous nitrogen consumption resumes at a value above the nominal flow (time $t_3$) the pressure drops and the solenoid valve 30 opens. This solenoid valve 30 is designed, in the open position, to let through a flow of liquid nitrogen at least equal to 15% of the nominal flow DN. Here again, the valve remains open until time $t_4$, when the consumption drops to the nominal flow or until the liquid level LR reaches the value L2.

After $t_4$, the liquid injection is stopped. The stored rich liquid alone provides the refrigeration for the distillation, and liquid injection is resumed only at time $t_5$ when the level LR reaches its minimal value L1. At this moment, the liquid injection amounts to 3% of the nominal flow in order to ensure nominal production of the apparatus.

It may be seen that during the periods $t_2$-$t_3$ and $t_4$-$t_5$, the liquid injection flow is zero, which represents an appreciable saving of liquid nitrogen.

Figure 2:
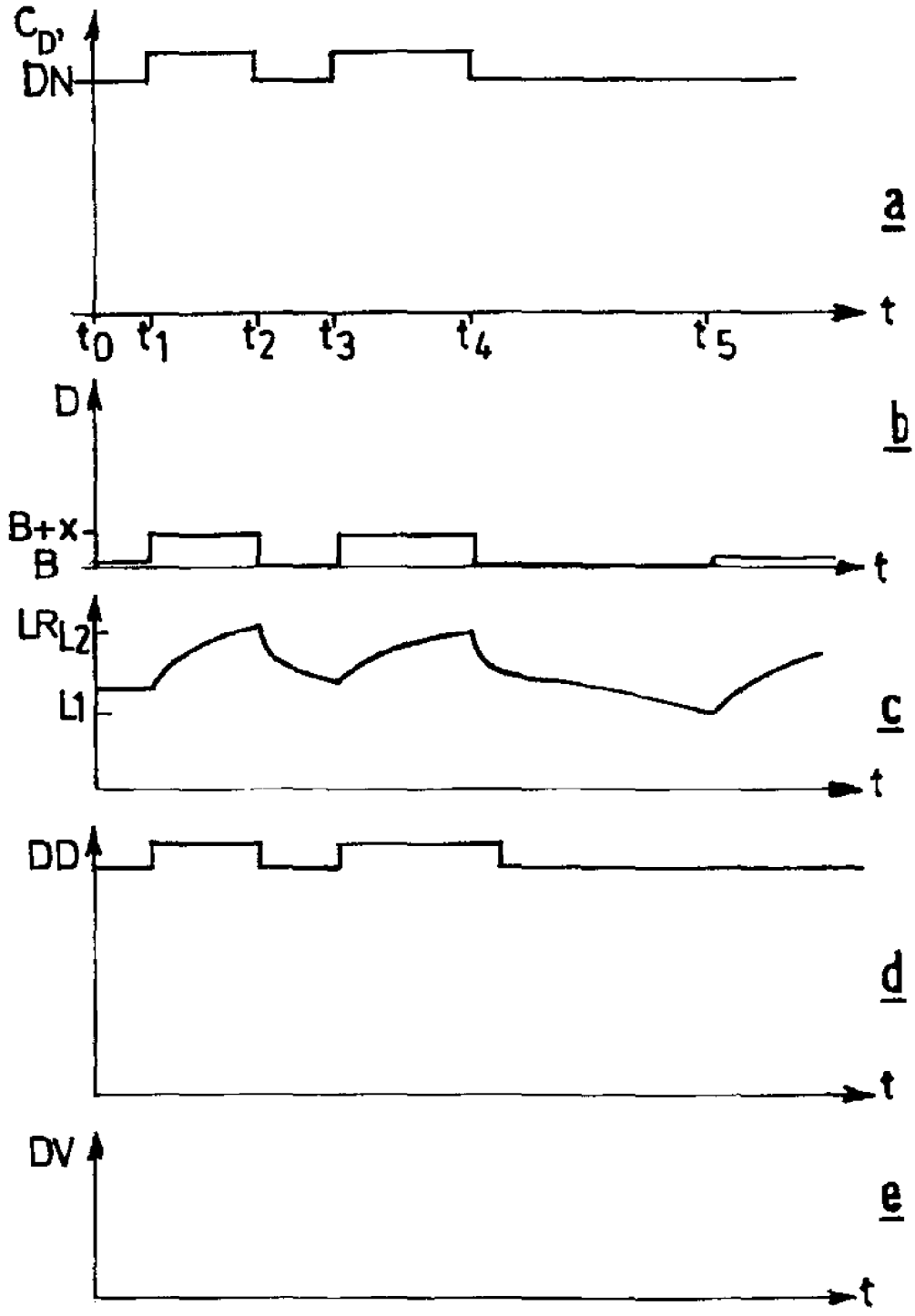
FIGS. 2, 3, 4A and 4B are diagrams illustrating the process according to the invention.

In FIG. 2, the distilled flow DD of FIG. 2*d* corresponds to the consumption C of FIG. 2*e*, but it will be explained later that this is not always the case.

Figure 3:
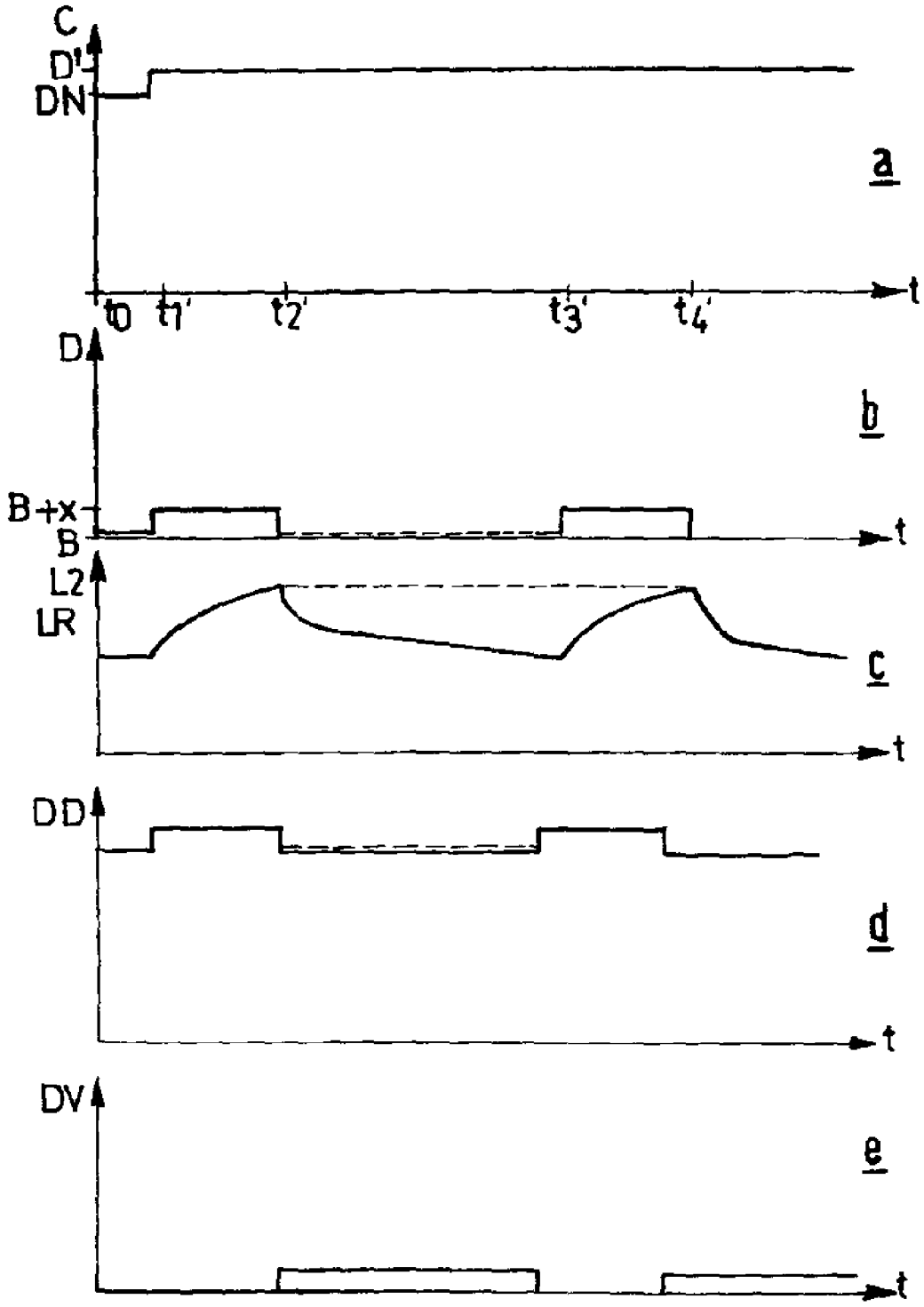

In the case of FIG. 3, the nominal flow DN for which the column is designed corresponds to $t<t_{1'}$. The nitrogen consumption C (FIG. 3*a*) is constant and equal to the nominal flow DN, and the sensor 19 indicates a constant pressure P. A low average flow of liquid nitrogen, for example equal to about 3% of DN (FIG. 3*b*) is introduced, via a line 20 equipped with a regulating solenoid valve 30, into the top of the column 10 and serves to keep it cold and also to increase the amount of reflux of the column. The incoming air, compressed by the compressor 14, pre-cooled by the air chiller 15, purified in the apparatus 12 and cooled down to close to its dew point in the exchanger 11, is introduced into the bottom of the column 10. The rich liquid that has collected in the bottom of the column is expanded in an expansion valve 22, vaporized in the overhead condenser 23 of the column, warmed by flowing counter-currently with the air in the exchanger and then used to regenerate the apparatus 12, before being discharged via a line 24 as waste gas.

At time $t_{1'}$ it will be assumed that the gaseous nitrogen consumption (or demand) starts to increase, reaching a fixed value above the nominal flow (FIG. 3*a*).

The flow D of injected liquid nitrogen is equal to 15% of the nominal flow, in order to increase the production of the column. Some of the liquid serving for the peak in consumption will be injected via the liquid injection line, to be "vaporized" in the distillation column. The refrigeration power is therefore recovered in the form of rich liquid in the bottom of the column, where it is stored. This store can then be used to keep the apparatus cold, instead of injecting liquid nitrogen.

The benefit of the invention is that it saves on liquid nitrogen, hence a reduction in operating costs.

If the level of rich bottoms liquid of the column 10 reaches a high value L2, by closing the valve 30 liquid nitrogen is stopped being sent to the top of the column from the line 20, and the production of the column is returned to its nominal value. Over a given period $t_{2'}$-$t_{3'}$, the apparatus may continue to produce the nominal flow, without liquid injection, by using the stored rich bottoms liquid to provide the refrigeration.

Since in this case the consumed flow C remains at its high value, it is not possible to operate with liquid injection after $t_{1'}$, the column bottoms level having reached the threshold L2. Here the top-up for the consumption is made through additional vaporization of liquid nitrogen (FIG. 3*e*), which is carried out in an auxiliary vaporizer 27, by opening a valve 28, without modifying the flow produced by distillation (FIG. 3*d*) (this flow remains (or returns to) its nominal value), and then this gaseous nitrogen DV is also fed into the tank 18. The valve 28 is opened when the pressure reaches a low value P1. This liquid nitrogen vaporization brings the pressure at 19 back to a value above the nominal value P (FIG. 3*e*).

When the liquid level LR reaches a value L1 at $t_{3'}$, the solenoid valve 30 opens. This solenoid valve 30 is designed, in the open position, to let through a flow of liquid nitrogen at least equal, in molar terms, to 15% of the nominal flow DN. Here again, the valve remains open until time $t_{4'}$, when the liquid level LR reaches the value L2. After time $t_{4'}$, the liquid injection is stopped. It may be seen that during the period $t_{2'}$-$t_{3'}$ and after $t_{4'}$, the liquid injection flow is zero, thereby representing an appreciable saving of liquid nitrogen.

In certain cases, the maximum liquid injection flow is insufficient to meet the entire increase in production required right from the start of the increase. In this case, part of the additional production comes from the column fed with an increased liquid injection flow and the remainder is produced by vaporizing liquid nitrogen in the emergency vaporizer.

Figure 4A:
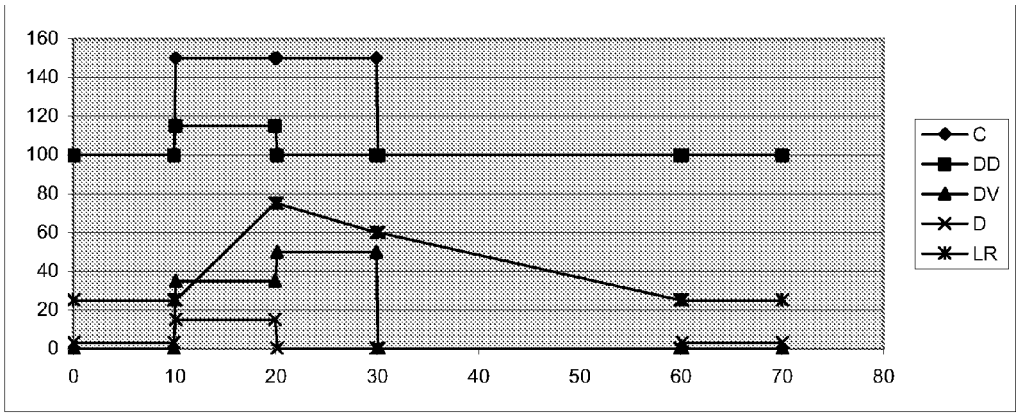

In FIG. 4A, when the nitrogen demand C by the customer increases, the distilled flow DD increases because of the increase in liquid injection flow D. To produce all the nitrogen needed, it is necessary at the same time to vaporize nitrogen in the emergency vaporizer in order to deliver a flow DV. The bottoms level LR rises up to a maximum value, at which moment the liquid injection is stopped, but the vaporization in the emergency vaporizer continues at a higher level, in order to produce all the additional nitrogen required. At the same time, the level of rich liquid in the bottom of the column drops. When the customer again requires less nitrogen, the emergency vaporization is stopped.

The variant (of FIG. 4A) with peak customer consumption above what the column can deliver

| | Time (min) | | | | | | | | | |
|---|---|---|---|---|---|---|---|---|---|---|
| | 0 | 9.9 | 10.1 | 19.9 | 20.1 | 29.9 | 30.1 | 59.9 | 60.1 | 70 |
| Customer consumption C | 100 | 100 | 150 | 150 | 150 | 150 | 100 | 100 | 100 | 100 |
| Flow DD produced by the column | 100 | 100 | 115 | 115 | 100 | 100 | 100 | 100 | 100 | 100 |
| Flow DV produced by the emergency vaporizer | 0 | 0 | 35 | 35 | 50 | 50 | 0 | 0 | 0 | 0 |
| Liquid injection flow D | 3 | 3 | 15 | 15 | 0 | 0 | 0 | 0 | 3 | 3 |
| Bottoms level LR | 25 | 25 | 25 | 75 | 75 | 60 | 60 | 25 | 25 | 25 |

The variant (of FIG. 4B) with peak customer consumption above what the column can deliver

| | Time (min) | | | | | | | | | |
|---|---|---|---|---|---|---|---|---|---|---|
| | 0 | 9.9 | 10.1 | 19.9 | 20.1 | 29.9 | 30.1 | 70 | 70.1 | 80 |
| Customer consumption C | 100 | 100 | 150 | 150 | 150 | 150 | 100 | 100 | 100 | 100 |
| Flow DD produced by the column | 100 | 100 | 115 | 115 | 100 | 100 | 100 | 100 | 100 | 100 |
| Flow DV produced by the emergency vaporizer | 0 | 0 | 35 | 35 | 50 | 50 | 0 | 0 | 0 | 0 |

-continued

| The variant (of FIG. 4B) with peak customer consumption above what the column can deliver | | | | | | | | | | |
|---|---|---|---|---|---|---|---|---|---|---|
| | Time (min) | | | | | | | | | |
| | 0 | 9.9 | 10.1 | 19.9 | 20.1 | 29.9 | 30.1 | 70 | 70.1 | 80 |
| Liquid injection flow D3 | 3 | 3 | 15 | 15 | 3 | 3 | 0 | 0 | 3 | 3 |
| Bottoms level LR | 25 | 25 | 25 | 75 | 75 | 75 | 75 | 25 | 25 | 25 |

Figure 4B:
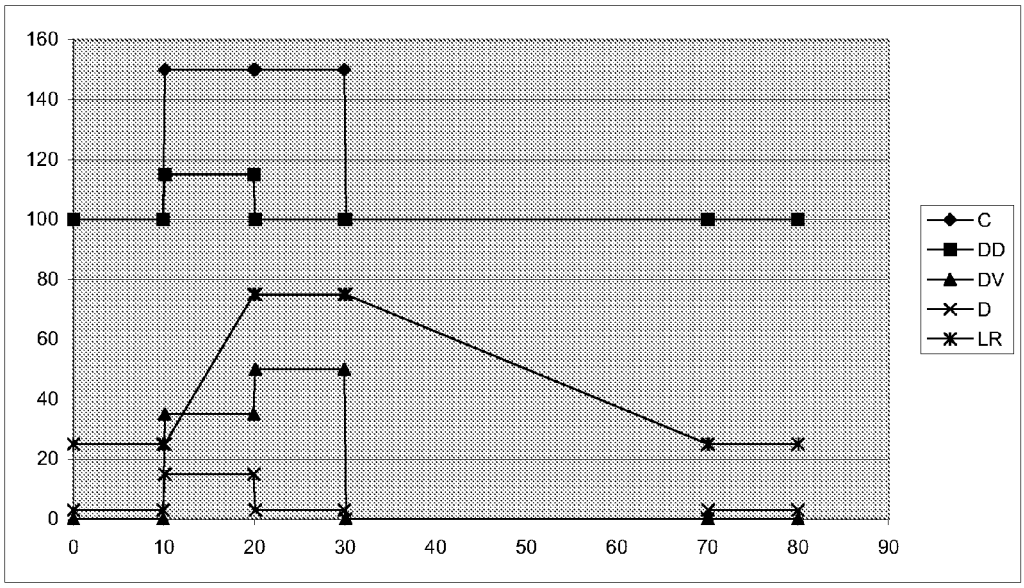

In the variant of FIG. 4B, when the LR level reaches L2 (high level), instead of cutting off the liquid injection and waiting until the level drops to L1 (in order to reactivate it at this moment), it is preferred to keep the level at its high level L2 with conventional 3% liquid injection (if the customer takes more, the rest is supplied by the emergency vaporizer). This makes it possible to have a maximum "flight time", since the store of liquid capacity is then at a maximum when the consumption by the customer resumes at its nominal value.

Firstly, the customer consumes at a nominal value (or less). The rich liquid level is regulated at the low threshold L1 with a conventional liquid injection flow D with a value B.

Next, the customer consumes more then the nominal value (C=150). The liquid injection is increased to B+x and therefore the production by the column increases correspondingly, in order to reach the high threshold L2 for the rich liquid LR (if there is time to reach it, depending on the duration of customer over-consumption).

Thereafter, a conventional liquid injection flow D of value B is used.

The consumption C by the customer drops to the nominal value (or less): the level of LR slowly drops down to L1 without liquid injection, and then the level of LR is regulated at the low threshold L1 with a conventional liquid injection flow D of value B.

Figure 5:
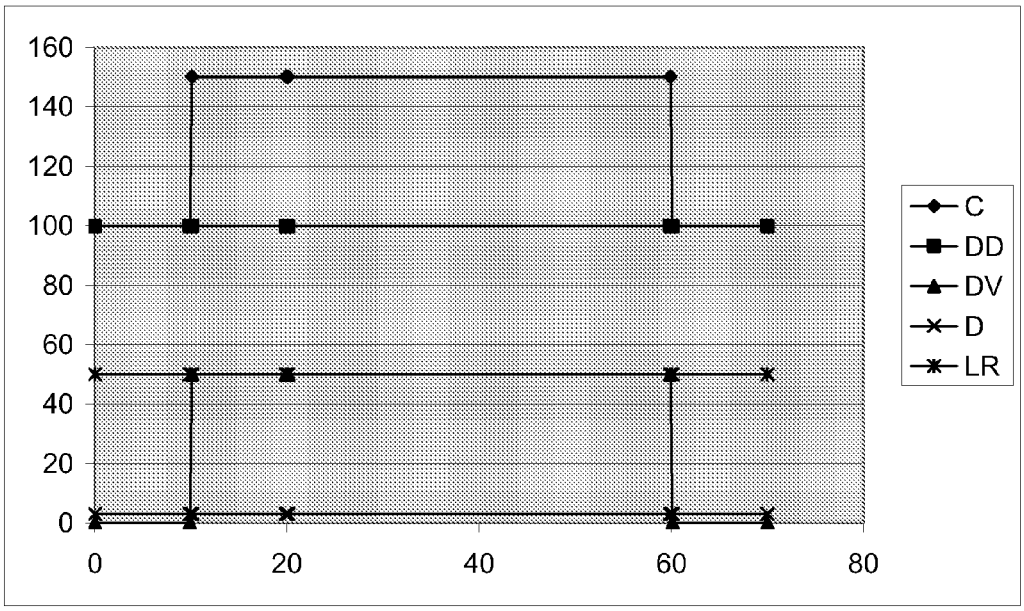
FIG. 5 is a diagram illustrating the process according to the prior art.

According to the prior art, the liquid injection flow remains constant outside the start-up, as may be seen in FIG. 5. To produce a larger quantity of nitrogen C demanded by the customer, it is necessary to vaporize nitrogen in an emergency vaporizer in order to supply an additional flow DV. This vaporization stops when the increased demand stops. The bottoms level LR of the column remains approximately constant.

| FIG. 5 | | | | | | | | |
|---|---|---|---|---|---|---|---|---|
| | Time (min) | | | | | | | |
| | 0 | 9.9 | 10.1 | 19.9 | 20.1 | 59.9 | 60.1 | 70 |
| Customer consumption C | 100 | 100 | 150 | 150 | 150 | 150 | 100 | 100 |
| Flow DD produced by the column | 100 | 100 | 100 | 100 | 100 | 100 | 100 | 100 |
| Flow DV produced by the emergency vaporizer | 0 | 0 | 50 | 50 | 50 | 50 | 0 | 0 |
| Liquid injection flow D | 3 | 3 | 3 | 3 | 3 | 3 | 3 | 3 |
| Bottoms level LR | 50 | 50 | 50 | 50 | 50 | 50 | 50 | 50 |

As already described in the prior art, the single nitrogen production column may be combined with an oxygen production column fed with an oxygen-enriched fluid coming from the single column.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A process for separating air using a cryogenic distillation system, the cryogenic distillation system comprising an air compressor, an air purifier, a heat exchanger, a distillation column, a LIN tank, a lower-liquid level controller, a LIN valve, a rich liquid expansion valve, the process comprising the steps of:

a) compressing an air feed in the air compressor to form a compressed air feed;

b) removing impurities from the compressed air feed in the air purifier;

c) cooling the compressed air feed in the heat exchanger to form a cooled air stream;

d) introducing the cooled air stream to the distillation column, the distillation column configured to separate nitrogen and oxygen;

e) introducing a first amount of liquid nitrogen from the LIN tank to the distillation column;

f) extracting nitrogen from the distillation column at a nominal flow rate; and g) measuring a liquid level of rich liquid near a bottom of the distillation column, wherein the cryogenic distillation system is configured to produce a second flow rate of nitrogen that is greater than the nominal flow rate by allowing an increased flow of liquid nitrogen from the LIN tank to the distillation column when the liquid level of the rich liquid near the bottom of the distillation column is at or below a maximum set point, wherein the increased flow of liquid nitrogen is in an amount greater than the amount needed to compensate for the second flow rate of nitrogen, thereby causing the liquid level of the rich liquid at the bottom of the distillation column to increase, h) extracting rich liquid from the distillation column;

i) expanding the rich liquid across the rich liquid expansion valve; and j) introducing the expanded rich liquid to a condenser in thermal communication with the distillation column to provide additional refrigeration to the distillation column.

2. The process as claimed in claim 1, wherein if the liquid level exceeds the maximum set point, the liquid nitrogen introduced into the distillation column from the LiN tank is reduced to the first amount.

3. The process as claimed in claim 1, wherein the increase in molar flow rate of the liquid nitrogen from the UN tank to the distillation column is between 0.8 and 1.2 times the molar flow rate increase of the second amount of nitrogen and the nominal flow rate.

4. The process as claimed in claim 1, wherein the increase x in molar flow rate of the injection flow during the second operation is between 0.8 and 1.2 times the increase in terms of molar flow rate of the flow produced by the column.

5. The process as claimed in claim 1, wherein the amount of nitrogen extracted in step f) from the distillation column is increased to an amount above the nominal flow rate during production of the second flow rate of nitrogen.

6. The process as claimed in claim 1, wherein the distillation column of the cryogenic distillation system is primarily responsible for producing the additional amount of nitrogen during production of the second flow rate of nitrogen.

7. An air separation process using cryogenic distillation, in which a variable flow of gaseous nitrogen is produced by means of an air distillation unit comprising an air distillation column suitable for producing a nominal flow of gaseous nitrogen, the top of said column being connected to a liquid nitrogen source, by carrying out the following steps:

i) during all operations of the column:
   a) a flow of compressed, cooled and purified air is sent to an exchanger and then to the column;
   b) a flow of gaseous nitrogen is withdrawn from the column;
   c) the level of liquid at the bottom of the column is controlled;
   d) no liquid nitrogen is sent from the column to the liquid nitrogen source;

ii) during a first operation of the column, when the required production corresponds to nominal production;
   a) a liquid injection flow B is sent to the column;

iii) during a second operation of the column, when the required production is above the nominal production:
   a) the liquid injection flow to the column is increased to B+x, wherein the increase x in molar flow rate of the injection flow during the second operation is greater than the amount needed to compensate for the required production above the nominal production thereby causing the level of liquid at the bottom of the column to increase; and
   b) the flow of gaseous nitrogen produced by the column is increased;

iv) during at least part of a third operation of the column, following the second operation, the required production becomes at most equal to the nominal production and the liquid injection flow is essentially stopped.

8. The Process as claimed in claim 7, in which the unit includes an emergency delivery system and in which, during the second and/or third operation of the column, liquid nitrogen is sent from the source to the emergency delivery system, where the liquid nitrogen vaporizes.

9. The Process as claimed in claim 7, in which, during a fourth operation of the column, liquid injection flow to the column is stopped if the level of bottoms liquid exceeds a first threshold, the required production not being reduced to at least the nominal production.

10. The Process as claimed in claim 7, in which during at least part of the third operation of the column when the level of bottoms liquid reaches a first threshold, injection liquid continues to be sent with a flow B so that the level of bottoms liquid remains constant, and the injection flow is stopped when the required production is at least reduced to the nominal production.

11. The Process as claimed in claim 7, in which, during a fourth operation of the column, injection liquid is again sent to the column if the level of bottoms liquid falls below a second threshold.

12. The Process as claimed in claim 11, in which, during the fourth operation, if the required production is equal to or less than the nominal production, a flow B of injection liquid is again sent to the column and no liquid flow is sent to an emergency delivery system.

13. The Process as claimed in claim 7, in which, during a fourth operation, if the required production is above the nominal production, a flow B+x of injection liquid is sent to the column.

14. The Process as claimed in claim 7, wherein the level of bottoms liquid in the column decreases during the second and/or third operation.

15. The Process as claimed in claim 7, wherein the level of bottoms liquid in the column increases during the first operation.

* * * * *